US005140113A

United States Patent [19]

Machado

[11] Patent Number: 5,140,113

[45] Date of Patent: Aug. 18, 1992

[54] DIFFERENTIAL PRESSURE CONTROL SWITCH WITH A PIVOTING ACTUATING LEVER AND A BIASING SPRING SEALED IN A HOUSING

[75] Inventor: John S. Machado, Woburn, Mass.

[73] Assignee: United Electric Controls Company, Watertown, Mass.

[21] Appl. No.: 704,033

[22] Filed: May 22, 1991

[51] Int. Cl.[5] ..... H01H 35/34

[52] U.S. Cl. ..... 200/83 J; 73/717; 73/745; 200/82 C; 200/834; 340/626

[58] Field of Search ..... 91/1; 92/5 R, 103 M; 73/716, 717, 723, 744, 745; 362/95, 802; 307/118; 340/626; 200/51 R, 81 R, 81.5, 82 R, 82 C, 82 A, 83 R, 83 A, 83 P, 83 S, 83 SA, 83 J, 83 Y, 310, 312, 302.3, 332, 332.1

[56] References Cited

U.S. PATENT DOCUMENTS

| | | | |
|---|---|---|---|
| 2,680,168 | 6/1954 | Murphy | 200/83 R |
| 2,982,830 | 5/1961 | Schaefer | 200/83 J |
| 3,657,501 | 4/1972 | Hoyt | 200/81.4 |
| 3,752,942 | 8/1973 | McAfer | 200/83 Y |
| 3,848,517 | 11/1974 | Hawke | 92/101 |
| 3,985,986 | 10/1976 | Doerfler | 200/83 Y |
| 4,081,636 | 3/1978 | Rice | 200/83 Y |
| 4,103,124 | 7/1978 | Reis | 200/51 R |
| 4,206,455 | 6/1980 | Isakson | 340/626 |
| 4,272,959 | 6/1981 | Yamane | 60/602 |
| 4,288,685 | 9/1981 | Tommaso | 219/309 |
| 4,503,301 | 3/1985 | Kurtz | 200/83 D |
| 4,743,716 | 5/1988 | Tsukioka | 200/83 Y |
| 4,804,808 | 2/1989 | Dal Cero | 200/61.25 |
| 4,951,810 | 8/1990 | Everett | 200/83 A |

*Primary Examiner*—Gerald P. Tolin
*Attorney, Agent, or Firm*—Wolf, Greenfield & Sacks

[57] ABSTRACT

A differential pressure control provides a housing having a pair of opposing inlets for accepting lines having different fluid pressures therein. The inlets are sealably connected to a central chamber having a piston by means of diaphragms. The piston is joined to a pivoting lever having a free end that translates as the piston is moved by each of the diaphragms. Upon existence of a pressure inbalance, the free end is moved by the piston, tripping a switch that indicates the pressure imbalance. The lever includes an adjustable spring to vary the gain of the switch and further includes a pair of opposing stops that limit the lever's displacement to substantially match that of the throw of the switch.

17 Claims, 3 Drawing Sheets

DIFFERENTIAL PRESSURE CONTROL SWITCH WITH A PIVOTING ACTUATING LEVER AND A BIASING SPRING SEALED IN A HOUSING

FIELD OF THE INVENTION

This invention relates to a differential pressure control switch and more particularly to a control switch that utilizes a pivoting actuating lever.

BACKGROUND OF THE INVENTION

Differential pressure switches are desirable in maintaining a predetermined pressure balance between opposing sources of fluid pressure. In general, an outlet from each pressure source is attached to a fluid/mechanical interconnection, such as a piston, that is, itself interconnected with a switch. As long as a predetermined balance is maintained, the piston remains stationary with the pressure induced forces in relative equilibrium and the switch carries a constant state. However, if the balance or difference of pressure becomes disturbed or altered relative to a predetermined value, the piston moves and, if the movement passes a given threshold value, the switch trips, changing the switch's state to generate an appropriate signal. The signal may include an alarm that an operator acts upon manually, or a control for automatic devices.

In a popular form of pressure switch that utilizes a moving piston disposed between a pair of outlets, switch contacts that are placed in alignment with the piston connect and disconnect alternatively in response to the piston's pressure induced movement. The alignment of contact circuitry directly with the piston, however, renders adjustment of gain or sensitivity more difficult and increases the complexity of the piston mechanism. The location of the switch and its circuitry proximate the piston also entails the use of the already limited space in the piston bore, thus making the inclusion of standardized electrical components more difficult. Additionally the placement of circuitry in direct contact with the fluid/mechanical elements increases the risk of their damage and long term degradation.

SUMMARY OF THE INVENTION

It is therefore an object of the present invention to provide a differential pressure control that may incorporate the use of standardized electrical components in a single housing.

It is another object of this invention to provide a differential pressure control that allows relatively easy adjustment of gain or sensitivity.

It is another object of this invention to provide a differential pressure control that utilizes a fluid/mechanical interconnection with a minimum of moving parts for increased reliability.

It is yet another object of this invention to provide a differential pressure control that utilizes a housing sized to allow positioning of a variety of signaling and control options therein.

A differential pressure control according to this invention features a housing formed from a rugged material such as glass filled polyester. The housing includes, near its bottom section, a pair of opposing inlets upon opposite sides of a central chamber. A pair of resilient diaphragms isolate the fluid of the inlets from the chamber but bulge into the chamber in response to a predetermined fluid pressure. Opposing sides of a piston located in the chamber engage each of the diaphragms. A pivotable lever is positioned through the center region of the piston in a direction transverse to the inlets so that any displacement imparted by the diaphragms to the piston causes a pivoting of the lever. The free end of the lever is operatively connected to a button of a microswitch that actuates in response to pivotal movement of the free end. The pressure sensitivity of the switch is controlled by means of an adjustable spring that biases the lever toward one of the diaphragms. The pivoting travel of the lever is limited by means of a pair of stops that restrict movement of the free end to a range substantially equal to that of the throw of the switch.

BRIEF DESCRIPTION OF THE DRAWING

The foregoing and other objects and advantages of the invention will become more apparent with reference to the following detailed description and drawing in which.

DETAILED DESCRIPTION OF THE PREFERRED EMBODIMENTS

Figure 1:
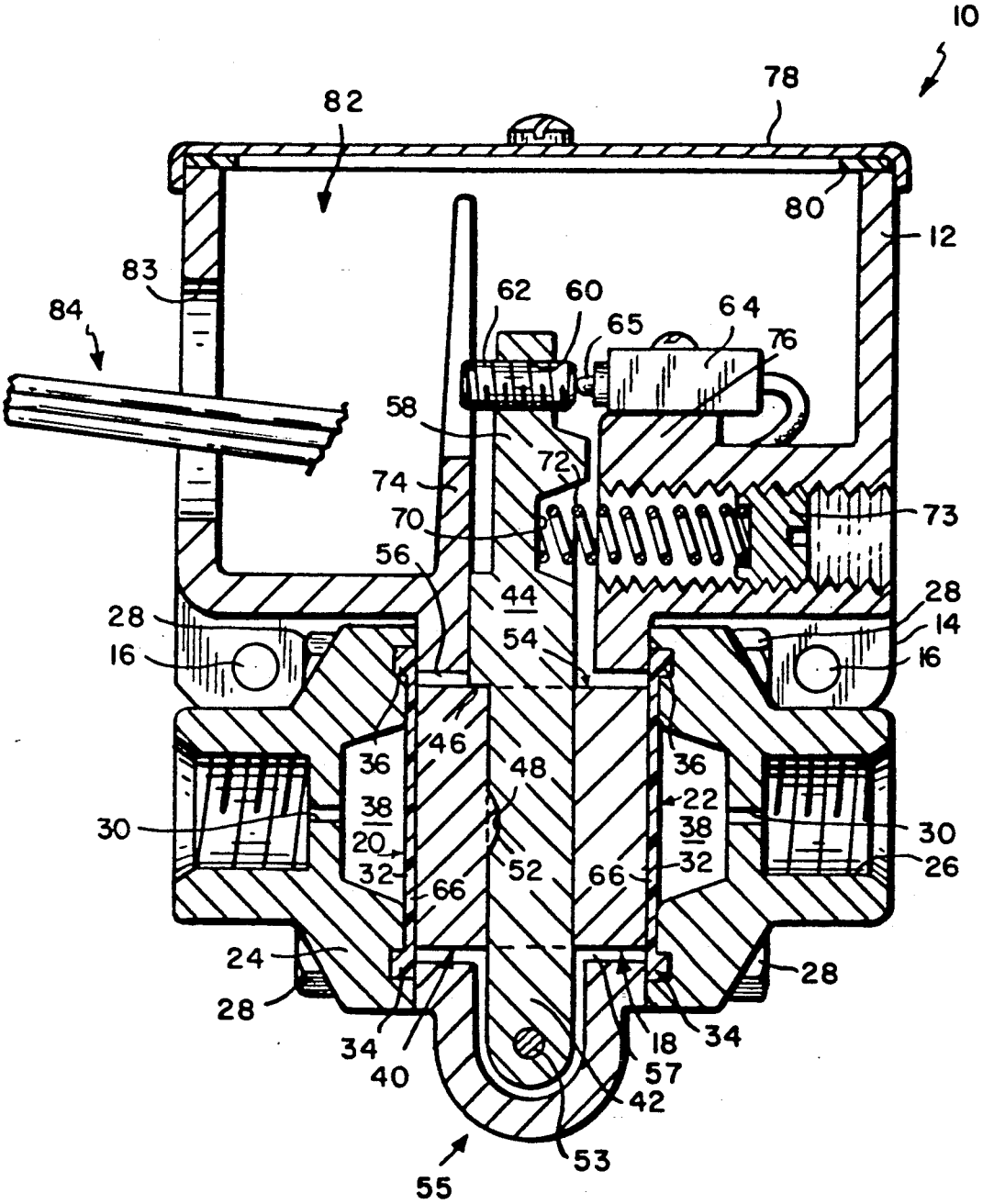
FIG. 1 is a cross-sectional elevation view of the differential pressure control according to this invention.

A differential pressure control 10 according to this invention is depicted generally in FIG. 1. The housing 12 that encases mechanism components comprises in this embodiment a 30% glass polyester (VALOX 865) that is molded and machined to include the various orifices for accepting the components. The housing 12 also includes a mounting base 14 with holes 16 for mounting the differential pressure control 10 in any desired location.

Figure 2:
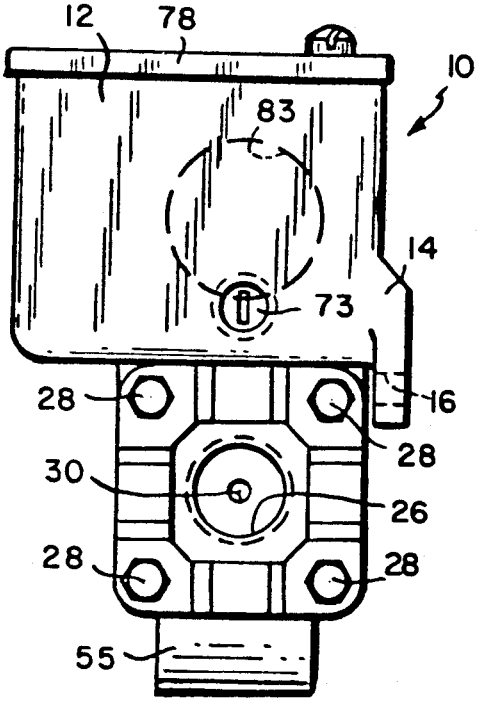
FIG. 2 is a right side elevation view of the differential pressure control housing of FIG. 1 including an inlet thereof.

The housing 12 defines a central chamber 18 having opposed high pressure and low pressure inlets 20 and 22, respectively, at its open ends that are adapted to carry connectors 24, 26 having threads or other means to which pressurized fluid lines (not shown) may be attached. In this embodiment, the connectors 24, 26 are formed separately of a polysulfone compound (UDEL) and are secured to the housing 12 by screws 28 (See FIG. 2). Each connector 24 or 26 further includes a relatively small diameter (0.062 inch in this example) hole 30 for allowing pressurized fluid to enter the central chamber 18. Between each inlet 20, 22 and the central chamber 18 is disposed a diaphragm 32 that in this example is formed of 0.005 inch thickness polyether material. The diaphragm 32 is secured in a sealed relationship relative to the chamber 18 between the housing 12 and an O-ring 34 disposed in an annular trough 36 about each of the connectors 24, 26. Each O-ring 34, in turn, seals the corresponding connector 24, 26 to the housing 12. Note that each connector 24, 26 includes a flared opening 38 proximate the chamber 18 to facilitate a wide fluid contact surface for its diaphragm 32. Each O-ring 34 is composed of ethylene propylene according to this example.

Figure 3:
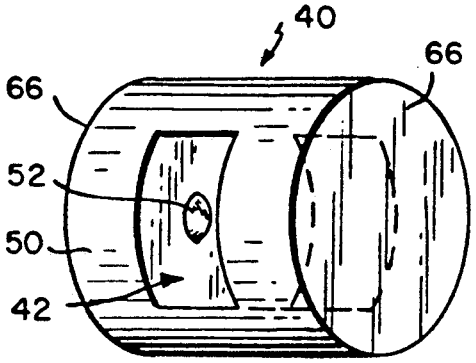
FIG. 3 is an enlarged perspective view of the piston used in the differential pressure control of FIG. 1.
Figure 4:
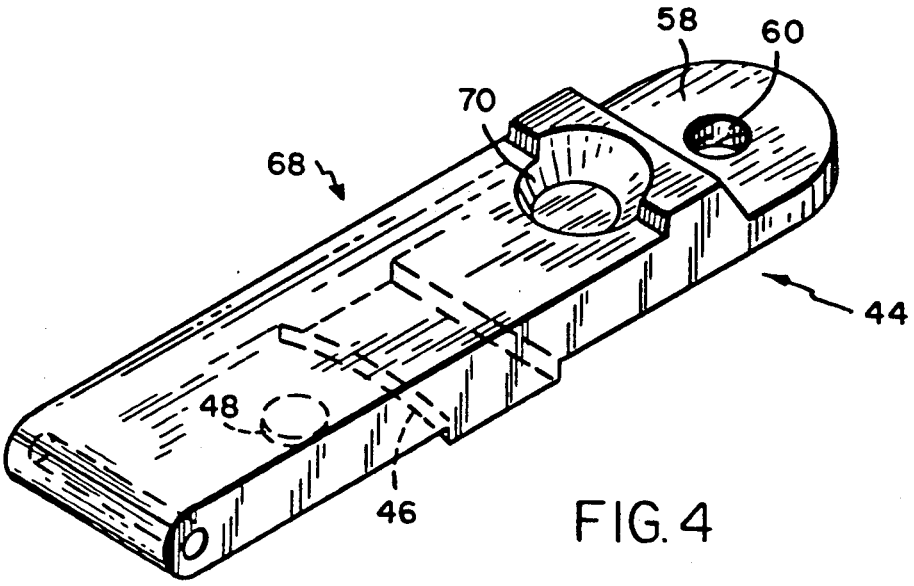
FIG. 4 is an enlarged perspective view of the lever used in the differential pressure control of FIG. 1.

The chamber 18 is sized to carry a piston 40 therein that is further detailed in FIG. 3 and includes a through cut slot 42 for receiving a lever 44. The lever 44 is, itself, further depicted in FIG. 4 and is formed with a curved shoulder 46 and indentation 48 (shown in phantom) to engage a conforming edge 50 and domed protrusion 52 on the piston 40. Thus, the piston 40 snaps into the desired fixed position upon the lever 44 to form an integral assembly. The construction of both the lever 44 and piston 40 from glass filled polyester or similar resilient material facilitates a quick snap fit assembly of components in this example.

The assembly of the lever 44 and piston 40 is disposed in the housing 12 to engage and pivot on a pin 53 in the lower portion 55 of the housing 12 between each of the diaphragms 32. The diameter of the piston 40 is sized smaller than that of the chamber 18 so that the piston's cylindrical wall at no time contacts the chamber's inner wall 56 while pivoting within the desired range of motion. As such a spacing 57 is shown between the piston and chamber in FIG. 1.

The upper free end 58 of the lever 44 includes a hole 60 (See FIG. 4) carrying a plunger 62 for contacting the button 65 of a housing-mounted SPDT (submininature snap acting) microswitch 64. The plunger 62 may be mounted in the hole 60 via threads to allow calibration adjustment. The switch 64 is rated, in this example, for 3 amps at 125–250 VAC. It is positioned to be tripped or fully "pressed" when the lever 44 is pivoted to the extreme right in housing 12 as viewed in FIG. 1. Note that since the microswitch is a momentary contact type, the button 65 releases automatically as the lever plunger 62 withdraws from it. Otherwise a mechanical linkage would be required to operate the switch. Furthermore, while a two state switch is used in this embodiment, the term "switch" should be taken to include, generally, a multiposition/multistate switch or a continuously variable control of electrical power or other influence in accordance with this invention.

As noted above, the diaphragms engage side walls 66 of the piston 40 to displace it. Each diaphragm 32 displaces toward its corresponding side wall 66 to exert force upon the piston in response to fluid pressure received through its respective inlet 20, 22. The diaphragms 32, thus push the piston 40 into an equilibrium position based upon the forces applied by the diaphragms and the resulting displacements.

The right side 68 of the lever 44 (See FIGS. 1 and 4) includes a recess 70 for receiving a metallic spring 72 for normally imparting additional biasing force upon the lever 44 toward the high pressure inlet 20 and away from the microswitch button 65. Thus, the spring 72 provides a force balance where one source pressure is substantially less than the other. An adjusting screw 73 which may be made of glass filled polyester alters the load applied by spring 72. Tightening the screw 73 toward the spring increases force against the lever, while the screw loosening decreases that force. By varying the load imposed by spring 72, the user may vary the balance of high pressure versus low pressure required to allow the lever 44 to pivot and thereby trip the microswitch 64. The forces of both the spring 72 and the low pressure of inlet 22 determine the total pressure required at the high pressure inlet 20 to trip the switch 64. Thus, if the high pressure source increases in value and/or the low pressure decreases in value, assuming the spring load remains constant, the balance of forces upon the lever 44 will cause it to displace and trip the switch 64. The actual amount of displacement, and hence, pressure differential, required to cause a state change of the switch depends upon the range of switch button 65 motion as well as the amount of additional spring 72 force present.

The housing 12 further includes a pair of integrally formed opposing stops 74 and 76. The stops 74, 76 engage the upper free end 58 of the lever 44 to limit left and right pivotal displacement and prevent hyperextension that might damage the delicate piston/diaphragm structure. The lever 44 and stops 74, 76 are sized and positioned so that the lever 44 only moves far enough in either direction to allow the switch button 65 to move between its on/off positions. Thus, the response time and sensitivity of the differential pressure control 10 of this embodiment is maximized because the lever experiences minimal intermediate motion between switch states.

The housing 12 according to this invention includes a screw mounted sheet steel cover 78 and gasket 80 that seals the upper portion 82 of the housing 12 to prevent infiltration of fluids that may damage and corrode internal system components such as the microswitch 64.

Figure 7:
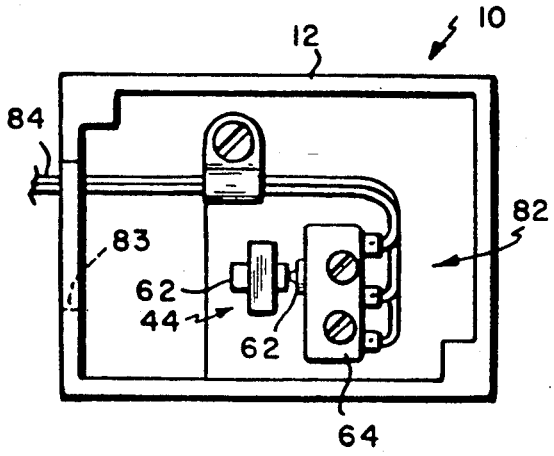
FIG. 7 is yet another top view of the differential pressure control housing of FIG. 1 with the cover removed (skeleton), and showing the lead wires thereof.

In use, the switch 64 is connected to external devices (not shown) by lead wires 84 connected thereto (See FIGS. 1 and 7) that extend through a conduit hole 83 in the upper portion 82 of the housing 12. The hole may include a sealing conduit to support the wires 84 securely and prevent liquid infiltration into the housing.

Figure 5:
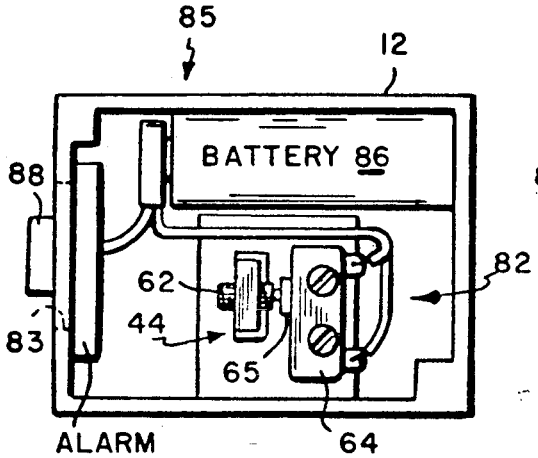
FIG. 5 is a top view of the differential pressure control housing of FIG. 1 with the cover removed, and including an alarm according to this invention.

In an alternative embodiment 85 depicted in FIG. 5, the upper portion 82 of the housing 12 further includes a battery (9 volt transistor radio dry cell in this example) 86 and an alarm 88 connected to the microswitch 64. If a pressure imbalance occurs, the microswitch 64 is tripped, sending current to the alarm 88 that alerts the operator. A piezoelectric alarm may be utilized according to this invention.

Figure 6:
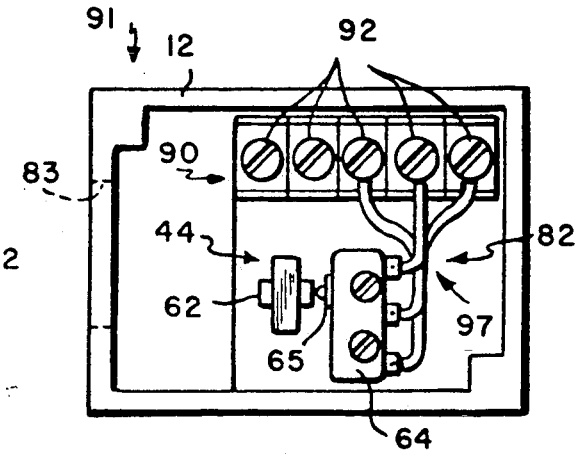
FIG. 6 is another top view of the differential pressure control housing of FIG. 1 with the cover removed, and including a terminal block structure according to the invention.

The upper portion 82 of the housing may include a terminal strip 90 as depicted in the alternative embodiment 91 of FIG. 6. The microswitch 64 leads 97 are connected to the terminal strip 90. This allows other automatic devices to be controlled based upon the state of the switch via connections with the strip 90.

Figure 8:
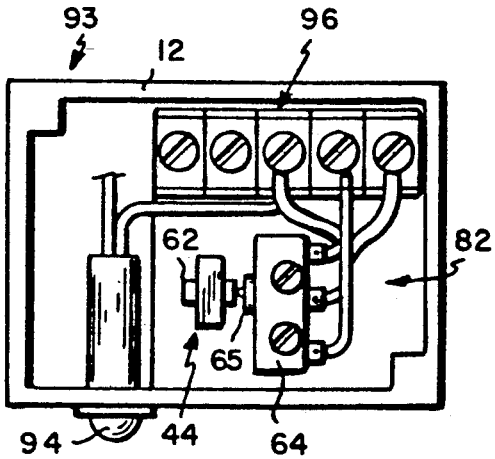
FIG. 8 is another top view of the differential pressure control housing of FIG. 1 with the cover removed, and including an LED indicator (one or two indicators) according to this invention.

In a further alternative embodiment 93 as depicted in FIG. 8, the upper portion 82 of the housing 12 includes an LED indicator 94 in combination with a terminal strip 96 that allows direct reading of the switch state at its source. This arrangement indicates a go/no go (on/-off) balance of pressures to the operator useful in process control and also facilitates quick testing of the differential pressure control of this embodiment 93 to ensure that it is functioning properly.

It should be understood that the preceding is merely a detailed description of the preferred embodiments of this invention and that various modifications may be made thereof without departing from the spirit or scope of the invention. The preceding description is meant to be presented only by way of example, and not to otherwise limit the scope of the invention.

What is claimed is:

1. A differential pressure control comprising:

a housing having a pair of opposed inlets for receiving fluid under pressure;

a piston movable in an axial direction between each of the inlets;

means permanently sealing the pair of opposed inlets wherein said sealing means transmits a displacement force from the fluid at each of the inlets to a corresponding side of said piston;

a lever having a pivot end and a free end disposed to pivot in the housing, the piston being attached to the lever between the pivot end and the free end whereby axial displacement of the sealing means causes pivotal displacement of the lever; and a switch disposed proximate the free end that is engaged and disengaged by said lever upon pivotal movement of said lever.

2. A differential pressure control as set forth in claim 1 further comprising stop means for limiting the range of pivotal movement of the lever disposed in the housing proximate the free end.

3. A differential pressure control as set forth in claim 2 further comprising a spring disposed in the housing proximate the free end of the lever connecting the lever to the housing which biases the lever toward one of the inlets.

4. A differential pressure control as set forth in claim 3 wherein the spring includes an adjustment screw positioned within the housing for increasing and decreasing force imparted by the spring to the lever.

5. A differential pressure control as set forth in claim 4 wherein the adjustment screw is accessible from a point outside the housing.

6. A differential pressure control as set forth in claim 1 wherein the switch ia a single-pole-double-throw microswitch.

7. A differential pressure control as set forth in claims 1, 2, 3, 4, 5 or 6, wherein the sealing means includes a diaphragm of resilient thin film material.

8. A differential pressure control as set forth in claims 1, 2, 3, 4, 5 or 6, further comprising an integral battery and alarm, the alarm being activated upon actuation of the microswitch and disposed within the housing.

9. A differential pressure control as set forth in claim 1 further comprising a plurality of terminals interconnected with the switch for generating a plurality of signals upon actuation of the switch.

10. A differential pressure control as set forth in claim 9 further comprising at least one indicator lamp located upon the housing and the lamp being interconnected to the terminals for signaling actuation of the switch.

11. A differential pressure control as set forth in claim 1 further comprising at least one indicator lamp located upon the housing for signaling actuation of the switch.

12. A differential pressure control as set forth in claim 1 wherein a portion of the housing proximate the switch is accessible through a removable cover and includes a location sized for mounting optional components therein.

13. A differential pressure control as set forth in claim 1 wherein the lever includes an adjustable plunger for contacting the switch, the plunger allowing variation of a contact point of the lever with the switch.

14. A differential pressure control as set forth in claim 3 wherein the spring biases the lever toward an inlet having a higher pressure applied thereto.

15. A differential pressure control as set forth in claim 14 wherein movement of the lever toward an inlet having a lower pressure activates the switch.

16. A differential pressure control as set forth in claim 1 further comprising a terminal strip electronically interconnected with the switch disposed in the housing.

17. A differential pressure control as set forth in claim 16 further comprising at least one audio alarm electrically interconnected with the terminal strip and disposed on the housing for indicating a predetermined switch state.

* * * * *